US008951137B2

(12) United States Patent
Egan

(10) Patent No.: US 8,951,137 B2
(45) Date of Patent: Feb. 10, 2015

(54) GOLF PUTTING AIMING AID

(71) Applicant: Leslie Egan, County Claire (IE)

(72) Inventor: Leslie Egan, County Claire (IE)

( * ) Notice: Subject to any disclaimer, the term of this patent is extended or adjusted under 35 U.S.C. 154(b) by 0 days.

(21) Appl. No.: 14/345,989

(22) PCT Filed: Sep. 20, 2012

(86) PCT No.: PCT/EP2012/068578
§ 371 (c)(1),
(2) Date: Mar. 20, 2014

(87) PCT Pub. No.: WO2013/041644
PCT Pub. Date: Mar. 28, 2013

(65) Prior Publication Data

US 2014/0228140 A1 Aug. 14, 2014

(30) Foreign Application Priority Data

Sep. 21, 2011 (IE) ..... S2011/0433

(51) Int. Cl.
*A63B 69/36* (2006.01)
*A63B 71/06* (2006.01)
*A63B 24/00* (2006.01)

(52) U.S. Cl.
CPC ..... *A63B 69/36* (2013.01); *A63B 69/3667* (2013.01); *A63B 69/3676* (2013.01); *A63B 71/06* (2013.01); *A63B 69/3614* (2013.01); *A63B 2207/02* (2013.01); *A63B 2220/16* (2013.01); *A63B 2220/805* (2013.01); *A63B 2024/0043* (2013.01); *A63B 2071/0694* (2013.01); *A63B 2243/0029* (2013.01)
USPC ..... 473/218; 473/220; 473/266

(58) Field of Classification Search
USPC ..... 473/218–220, 266–270
See application file for complete search history.

(56) References Cited

U.S. PATENT DOCUMENTS

| | | | | |
|---|---|---|---|---|
| 6,071,202 | A * | 6/2000 | Densberger et al. | 473/409 |
| 6,375,579 | B1 * | 4/2002 | Hart | 473/131 |
| 7,727,079 | B1 | 6/2010 | Kuhlman | |
| 2006/0122001 | A1 * | 6/2006 | Gaddy | 473/220 |
| 2007/0099729 | A1 | 5/2007 | Green | |
| 2007/0243942 | A1 * | 10/2007 | Elliott | 473/220 |
| 2009/0017943 | A1 * | 1/2009 | Landry | 473/404 |

(Continued)

*Primary Examiner* — Raleigh W Chiu
(74) *Attorney, Agent, or Firm* — Tutunjian & Bitetto, P.C.

(57) ABSTRACT

The present invention is directed towards a golf shot set up and aiming aid. The aid comprises a direction sensing means (104) and at least one illumination means (106), whereby the illumination means is capable of projecting a set-up line (200, 202) and aiming line (230, 204) on a playing surface for the user, and, the illumination means is rotatable about a substantially vertical axis (110) in response to feedback from the direction sensing means. In this manner, after acquisition of an intended target by the user along an imaginary target line, the direction sensing means can be used to detect if the aid is moved or rotated in such a manner as to no longer face towards the intended target. If so, the illumination device which is rotatable will be turned to account for any rotation imparted to the aid. Therefore, once the target has been acquired, the user can place the aid onto the ground without worrying about rotating the aid inadvertently as the aid is placed on the ground. Once on the ground, the illumination device can project the set-up line and the aiming line onto the playing surface for the user. With the aid of the present invention, the user is able to establish the aiming line towards the intended target and subsequently place the aid on the ground so that they can retrieve the correct club and approach and address the golf ball in their own time.

20 Claims, 12 Drawing Sheets

(56) References Cited

U.S. PATENT DOCUMENTS

| | | | | |
|---|---|---|---|---|
| 2009/0143157 | A1 | 6/2009 | Ross et al. | |
| 2009/0149267 | A1* | 6/2009 | Johnson et al. | 473/220 |
| 2009/0181784 | A1* | 7/2009 | Wilson et al. | 473/220 |
| 2010/0216561 | A1* | 8/2010 | Brown et al. | 473/220 |
| 2010/0267460 | A1* | 10/2010 | Kuhlman et al. | 473/220 |
| 2011/0237343 | A1* | 9/2011 | Bowman et al. | 473/270 |
| 2014/0228140 | A1* | 8/2014 | Egan | 473/218 |

* cited by examiner

GOLF PUTTING AIMING AID

This invention relates to a golf aid, and in particular to a golf shot set-up and aiming aid for use by golfers on golf courses, practice ranges and the like.

Golf is a widely popular game played throughout the World. A game of golf is won by completing all of the holes on the course in the fewest number of golf shots. Thus, it is imperative that a golfer sets up their golf shot correctly so that they accurately aim their next golf shot towards an intended target.

In addressing a golf ball, to strike the golf ball towards the intended target, the golfer should maintain a stance with their feet approximately shoulder width apart and longitudinal axes of their feet aligned substantially orthogonally to an imaginary aiming line which is directed from the golf ball towards the intended target. In this manner, a normal golf swing should result in the face of the golf club striking the ball at the correct angle so as to send the golf ball towards the intended target substantially along the imaginary aiming line.

However, in addressing the golf ball to take their golf shot it is very common, and particularly so for amateur golfers with higher handicaps, to misalign their feet so that their stance is not set up correctly relative to the imaginary aiming line which is directed towards the intended target. This causes the golf shot to be aimed inaccurately at the intended target due to the fundamentally erroneous set-up by the golfer. Even a perfect golf swing cannot correct this fundamental error in the golf shot set-up and it is thus very important that a correct golf shot set-up and golf shot aiming alignment be established from the outset.

A golfer can check their stance to see if it set up correctly by drawing an imaginary foot alignment line from the foremost part of one foot to the foremost part of the other foot. This imaginary foot alignment line should run in parallel with the imaginary aiming line towards the intended target.

U.S. Patent Publication Number US2008/0032809 (KOREJWA) is the closest known prior art and discloses a golf stance laser alignment device. The golf stance laser alignment device comprises a periscope sighting lens attached to a telescope, whereby the periscope sighting lens is at a right angle to the telescope so that the user may adopt a sideward stance to an intended target which is located through the telescope. The golf stance laser alignment device comprises a laser generated light line projected on the ground to indicate the accurate foot alignment to the intended target. It is understood that a user would have to use the golf stance laser alignment device to align their feet, and then subsequently store the golf stance laser alignment device, retrieve their golf club and play their golf stroke without moving their feet. This is due to the fact that the laser generated light line projected on the ground will only indicate the correct alignment when the intended target is being viewed through the telescope. Once a user moves the golf stance laser alignment device such that the telescope is no longer pointing in the direction of the intended target, the laser generated light line projected on the ground will correspondingly move and thus no longer indicate the correct foot alignment. It is for this reason that the user must store the golf stance laser alignment device, retrieve their golf club and play their golf stroke without moving their feet, once they have correctly aligned their feet.

There is clearly a disadvantage to this known prior art device which requires the user to continually hold the golf stance laser alignment device pointing in the direction of the intended target in order to have the accurate foot alignment indicated by the laser generated light line projected on the ground. Whilst continually holding the golf stance laser alignment device pointing in the direction of the intended target, the user will be able to set up the correct stance, but thereafter will have to store away the golf stance laser alignment device in order to play the golf stroke. Thus, the user cannot move their feet once they have set up the correct stance.

Being forced to keep their feet in place whilst storing the golf stance laser alignment device and retrieving the club is cumbersome and may also be unsettling for the user.

If the user moves their feet inadvertently, the entire process must be repeated by locating the intended target in the telescope, projecting the correct foot alignment lines on the golf course, and setting up their feet alignment accurately. This can lead to a frustrating experience for the user and indeed any playing partners in the user's round of golf.

It is a goal of the present invention to provide an apparatus that overcomes at least one of the above mentioned problems.

SUMMARY OF THE INVENTION

The present invention is directed towards a golf shot set-up and aiming aid for a user, the aid comprising a direction sensing means and at least one illumination means; the illumination means being capable of projecting a set-up line and aiming line on a playing surface for the user; and, the illumination means being rotatable about a substantially vertical axis in response to feedback from the direction sensing means.

The advantage of using a direction sensing means and an illumination device which is rotatable is that after acquisition of a target along an imaginary target line, the direction sensing means can be used to detect if the aid is moved in such a way as to turn or rotate the aid to no longer face towards the intended target, and the illumination device which is rotatable may be turned to account for any rotation imparted to the aid. Therefore, once the target has been acquired, the user can place the aid onto the ground without worrying about rotating the aid inadvertently as the illumination device which is rotatable will be rotated to account for this. Once on the ground, the illumination device can project the set-up line and the aiming line onto the playing surface for the user. With the aid of the present invention, the user is able to establish the aiming line towards the intended target and subsequently place the aid on the ground so that they can retrieve the correct club and approach and address the golf ball in their own time.

In a further embodiment, the aid comprises a motor which is connected to the illumination means and is capable of rotating the illumination means about the substantially vertical axis.

In a further embodiment, the aid comprises a processor and the direction sensing means comprises a Micro Electro-Mechanical (MEM) gyroscope, such that the processor receives feedback from the Micro Electro-Mechanical gyroscope regarding any rotation of the aid, and, the processor controls the motor to rotate the illumination means so as to account for the rotation of the aid.

The advantage of using a Micro Electro-Mechanical gyroscope is that the aid is relatively robust. This is important as the aid will be kept in a golf bag which will be subject to varying weather conditions and undulating terrain.

In a further embodiment, the aid comprises a battery, and, upon the user activating the aid, an electrical voltage is established across the Micro Electro-Mechanical gyroscope using the battery in order to allow the Micro Electro-Mechanical gyroscope to detect any rotation of the aid, and, the battery powers the illumination means to project the set-up line and the aiming line on the playing surface for the user.

In a further embodiment, the aid comprises a timer and, upon the user activating the aid, the Micro Electro-Mechanical gyroscope and the illumination means are both activated for a preset period of time.

In a further embodiment, the direction sensing means comprises a gyroscope.

In a further embodiment, the illumination means is rotatable about the substantially vertical axis in response to a biasing force provided by the gyroscope.

In a further embodiment, the direction sensing means is a compass.

In a further embodiment, upon a user-specified direction being chosen, the illumination means may be rotated so as to remain substantially facing in a direction, defined relative to the user-specified direction, through rotation about the substantially vertical axis and in response to feedback from the direction sensing means.

The advantage of causing the illumination means to be rotated so as to remain substantially facing in a direction, defined relative to the user-specified direction, is that the user, having acquired the target, does not need to carefully handle the aid so as to keep it facing in the correct direction, the user can place the aid onto the paying surface without any care given to whether the aid is being rotated as, through rotation about the substantially vertical axis, the illumination means will be rotated in response to feedback from the direction sensing means so as to keep the illumination means facing in the direction which will cause the set-up line and the aiming line to be project correctly for the intended target which has been acquired by the user.

In a further embodiment, the illumination means projects the set-up line for a user to correctly align their feet, and, the aiming line for the user to correct align a golf club.

In a further embodiment, the aiming line comprises a pair of substantially orthogonally arranged lines which project a cross on the playing surface where a golf ball to be played should be located.

In a further embodiment, the aid may comprise means for altering a distance between the set-up line and the aiming line, when the set-up line and the aiming line are projected onto the playing surface.

In a further embodiment, the gyroscope comprises spinning a gyroscopic wheel rotatable about a gyroscopic axis.

In a further embodiment, the aid further comprises an activation means which causes the gyroscope to be initially reset to a default position and thereafter activate, and, subsequently causes a user-specified direction to be acquired after activation of the gyroscope.

In a further embodiment, the illumination means comprises a plurality of light emitting diodes arranged to display the set-up line for the user's stance and the aiming line.

In a further embodiment, the aid comprises an adjustable projection timer which may be adjusted to alter the length of time which the illumination means projects the set-up line and/or the aiming line on the playing surface for the user.

The advantage of altering the length of time which the illumination means projects the set-up line and/or the aiming line on the playing surface is that the aiming line and/or the set-up line can be switched off if the user feels that they are distracting during the user playing their golf stroke. Furthermore, different golfers have different set up times and golfers can adjust the length of time to suit their game. This will allow golfers with a relatively short set up time to shorten the length of time, and thus increase the battery life of the aid.

In a further embodiment, the illumination means comprises a plurality of lasers to project the set-up line and the aiming line on the playing surface for the user.

In a further embodiment, the illumination means comprises a single laser and the aid further comprises a reflector, whereby the reflector reflects light from the single laser to project the set-up line and the aiming line on the playing surface for the user.

In a further embodiment, the illumination means is arranged to project the set-up line and the aiming line on the playing surface when the aid is resting on the playing surface.

In a further embodiment, the aid comprises a casing having a substantially planar base face, and the illumination means is arranged to project the set-up line and the aiming line on the playing surface when the substantially planar base face of the aid is in abutment with the playing surface.

The present invention is directed to a golf shot set-up and aiming aid comprising a viewfinder, a gyroscope, and, at least one illumination means; the illumination means displaying a set-up position and aiming direction for a user, and, being rotatable about a substantially vertical axis; whereby, a user-selected direction may be chosen using the viewfinder; and, the illumination means may be locked to face in a direction, defined relative to the user-selected direction, through rotation about the substantially vertical axis in response to a biasing force provided by the gyroscope.

The advantage of providing such a golf shot set-up and aiming aid is that the gyroscope will correct for any changes to the orientation of the golf shot set-up and aiming aid as the user transitions the golf shot set-up and aiming aid from a position adjacent their eye line to chose the user-selected direction using the viewfinder, to a position on the golf playing surface in order to allow the illumination means to display the set-up position and/or aiming direction for the user.

In a further embodiment, the set-up and aiming aid further comprises an activation means which causes the gyroscope to be initially reset to a default position and thereafter activated, and, subsequently causes the user-selected direction to be acquired after activation of the gyroscope.

In a further embodiment, the set-up and aiming aid comprises a target acquisition indicator to inform the user when the user-selected direction has been acquired.

In a further embodiment, the target acquisition indicator is switched on after a preset period of time, from the activation of the gyroscope, has elapsed.

In a further embodiment, the activation of the gyroscope comprises spinning a gyroscopic wheel about a gyroscopic axis.

In a further embodiment, the gyroscope comprises a gyroscopic wheel which rotates about a gyroscopic axis, and, the set-up and aiming aid further comprises an activation means which causes the user-selected direction to be acquired by obtaining the angular displacement of the gyroscopic axis relative to a default, known position.

In a further embodiment, the gyroscope is an electronic gyroscope.

In a further embodiment, the set-up and aiming aid further comprises an activation means which causes the user-selected direction to be acquired by obtaining readings from the electronic gyroscope regarding the displacement of the electronic gyroscope from a default, known position.

In a further embodiment, the electronic gyroscope is a Micro Electro-Mechanical (MEM) gyroscope.

In a further embodiment, the illumination means comprises a laser to display a golf shot stance set-up for the user and/or a golf shot aiming line for the user.

In a further embodiment, the illumination means comprises a plurality of light emitting diodes arranged to display a golf shot stance set-up for the user and/or a golf shot aiming line for the user.

In a further embodiment, the illumination means projects a golf shot stance set-up and a golf shot aiming line onto a golf playing surface in front of the user.

DETAILED DESCRIPTION OF EMBODIMENTS

The invention will be more clearly understood from the following description of some embodiments thereof, given by way of example only with reference to the accompanying drawings, in which.

Figure 1:
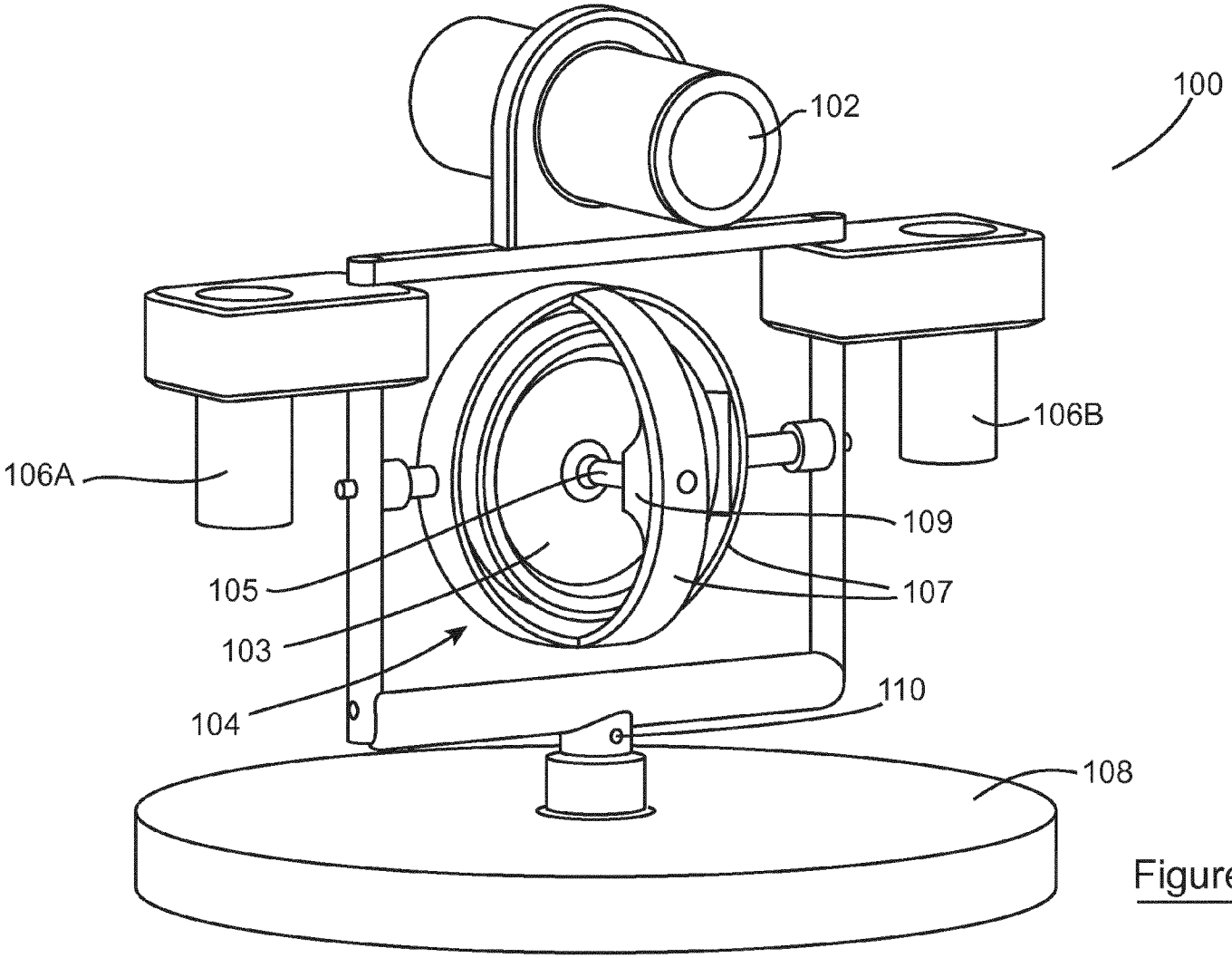
FIG. 1 is a perspective view of a golf aid in accordance with the present invention.

Referring to FIG. 1, there is provided a golf shot set-up and aiming aid indicated generally by reference numeral 100. The golf shot set-up and aiming aid 100 comprises a viewfinder 102, a gyroscope indicated generally by reference numeral 104, and a pair of illumination means 106A, 106B.

The gyroscope 104 comprises a gyroscopic wheel 103 which is free to rotate about a gyroscopic axis 105, which in turn is mounted in a pair of gimbals 107. The gyroscopic wheel 103 is driven by a motive means 109. The gyroscope 104 is activated by an activation means (not shown). As is readily understood by any skilled practitioner, whilst in operation, the gyroscope will maintain its orientation in space due to the conservation of angular momentum.

The gyroscope 104, viewfinder 102 and illumination means 106A, 106B are rotatably mounted on a base 108 so that the gyroscope 104, viewfinder 102 and illumination means 106A, 106B may rotate about a substantially vertical axis 110 through substantially 360°.

Figure 2:
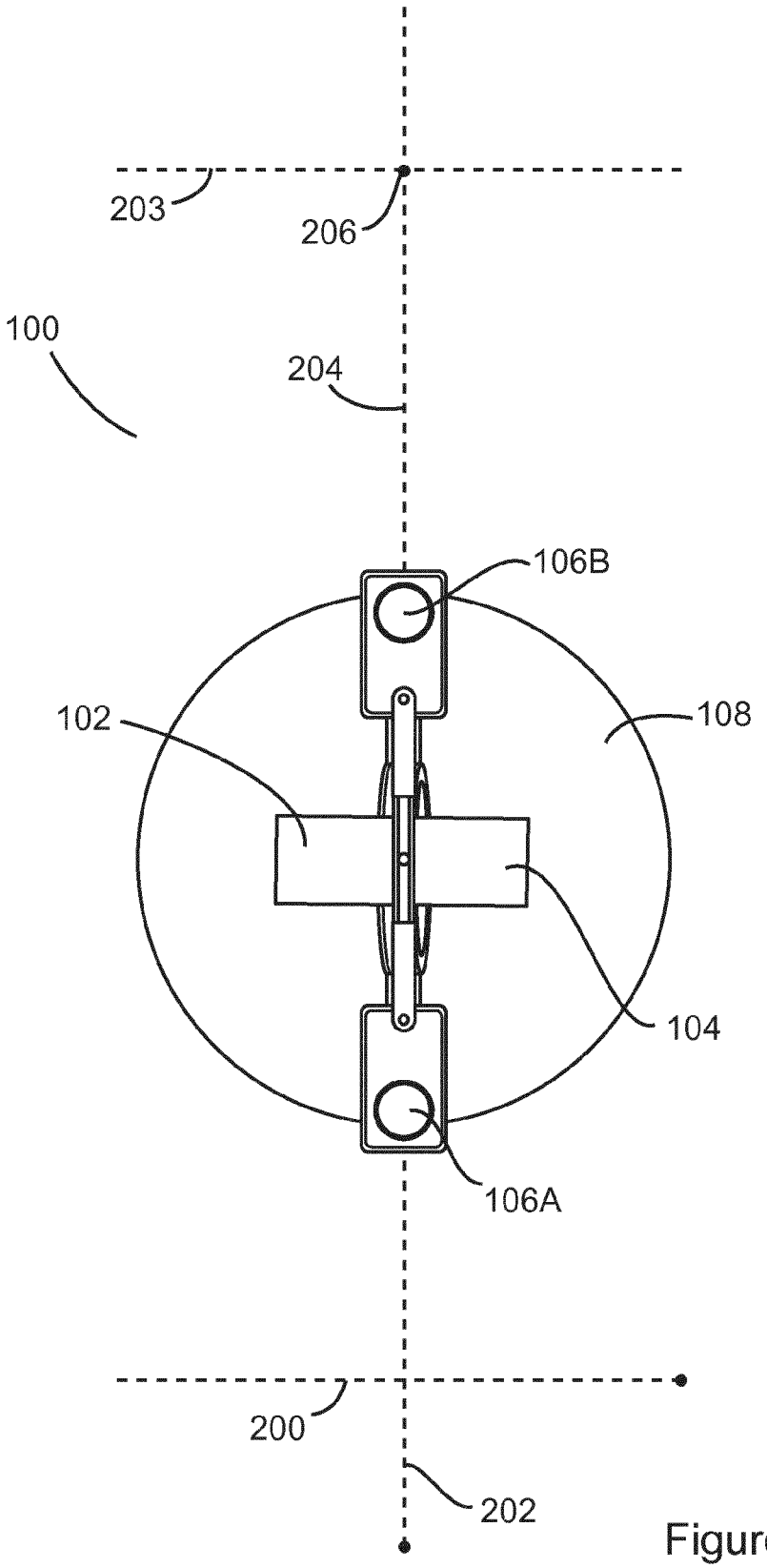
FIG. 2 is a top view of the golf aid of FIG. 2 showing direction-indicating aiming lines.

In use, and referring to FIGS. 1 and 2, the golf shot set-up and aiming aid 100 is operated by a user, who is likely to be a golfer or a caddy, by firstly orientating the golf shot set-up and aiming aid 100 towards an intended target by using the viewfinder 102 to locate the intended target and direct the golf shot set-up and aiming aid 100 towards the intended target. Once the intended target has been accurately located by the user using the viewfinder 102, the user will activate the golf shot set-up and aiming aid 100 by engaging an activation means (not shown) on the golf shot set-up and aiming aid 100. For example, this could entail depressing an activation button (not shown) on the golf shot set-up and aiming aid 100. Once the golf shot set-up and aiming aid 100 has been activated, this will activate the gyroscope 104 by causing the motive means 109 to spin the gyroscopic wheel 103. After a preset period of time has elapsed, for example one second, an indicator (not shown) is illuminated to inform the user that the golf shot set-up and aiming aid 100 has acquired the intended target. This is to allow sufficient time for the gyroscope 104 to become activated and establish a holding orientation.

At this point, the user may place the golf shot set-up and aiming aid 100 on a playing surface. The illumination means 106A, 106B which are preferably lasers, but may also be alternatively made up of a plurality of light emitting diodes (LEDs) or other such illumination means, are illuminated when the activation means is engaged. The illumination means 106A, 106B project a golf shot stance set-up line for the user comprising a foot alignment line 200 and a proximal centre line 202; and, an aiming line for the user comprising an imaginary target line 203 and a distal centre line 204. The imaginary target line 203 and the distal centre line 204 intersect at a golf ball positioning spot 206.

The gyroscope 104 holds the orientation set by the user, which is directed towards intended target, even if the user rotates the golf shot set-up and aiming aid 100 as they move the golf shot set-up and aiming aid 100 from adjacent their eye line to placing the golf shot set-up and aiming aid 100 on the playing surface. The user will overlap the ball positioning spot 206 with their golf ball and the proximal centre line 202 and the foot alignment line 200 will direct the golfer to adopt the correct set-up stance in addressing the golf ball which is to be struck towards the intended target. In this manner, the illumination means 106A, 106B is locked to face in a direction, defined relative to the user-selected direction, through rotation about the substantially vertical axis 110 in response to a feedback, in the form of a biasing force provided by the gyroscope 104 to rotate the illumination means 106A, 106B. The illumination means 106A, 106B are locked to face in a direction which is substantially orthogonal to the user-selected direction towards the intended target, which is to say that the proximal centre line 202 and the distal centre line 204 are directed substantially orthogonally to the imaginary aiming line (not shown) directed at the intended target (not shown), and, the foot alignment line 200 is arranged to be substantially in parallel with the imaginary aiming line (not shown) directed at the intended target (not shown).

It will be understood that the foot alignment line 200 may be adjustable relative to the ball positioning spot 206 to accommodate golfers of different heights. A relatively tall golfer would require the foot alignment line 200 to be set at a distance further away from the ball positioning spot 206 than a relatively short golfer.

Moreover, the proximal centre line 202 is used by the golfer to establish the correct position of their stance relative to the golf ball. For example, when using a driver, a right-handed golfer will normally stand with the golf ball just inside their front foot, which will be their left foot. This is to say that the proximal centre line 202 should be just inside their stance beside the inner side of their left foot. As the golfer uses clubs with shorter shafts, their position relative to the golf ball will change. For example, the proximal centre line 202 will be approximately in the middle of their stance for a five iron (5I) or six iron (6I) golf club, and, for a pitching wedge (PW) the golfer's position relative to the golf ball will be such that the proximal centre line 202 will be just inside their back foot, which will be their right foot. This is to say that the proximal centre line 202 should be just inside their stance beside the inner side of their right foot when using the pitching wedge.

Furthermore, the distal centre line 204 can be used to ensure correct and straight alignment of the face of the golf club by aligning the foremost bottom edge of the golf club face to be substantially in parallel with the distal centre line 204.

Figure 3:
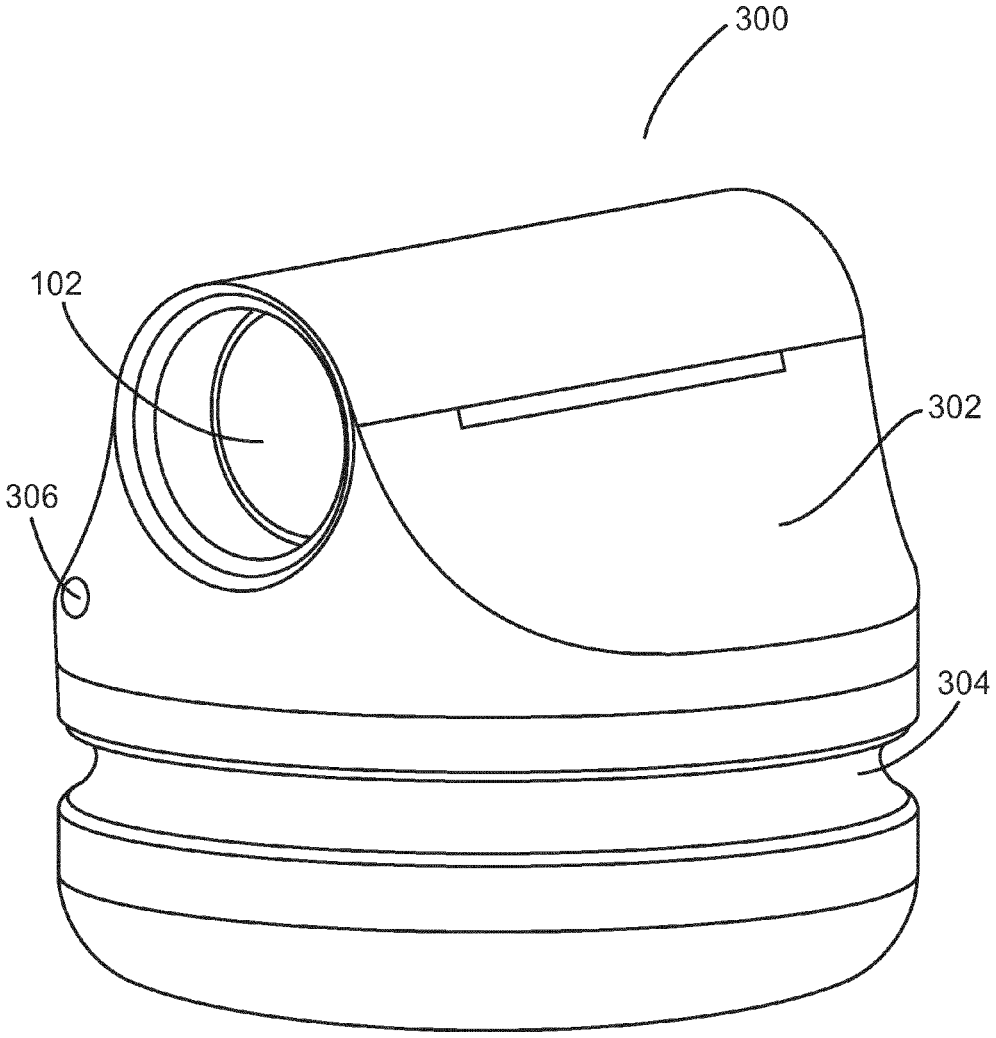
FIG. 3 is a perspective view of a golf aid in accordance with a further embodiment of the present invention.
Figure 4:
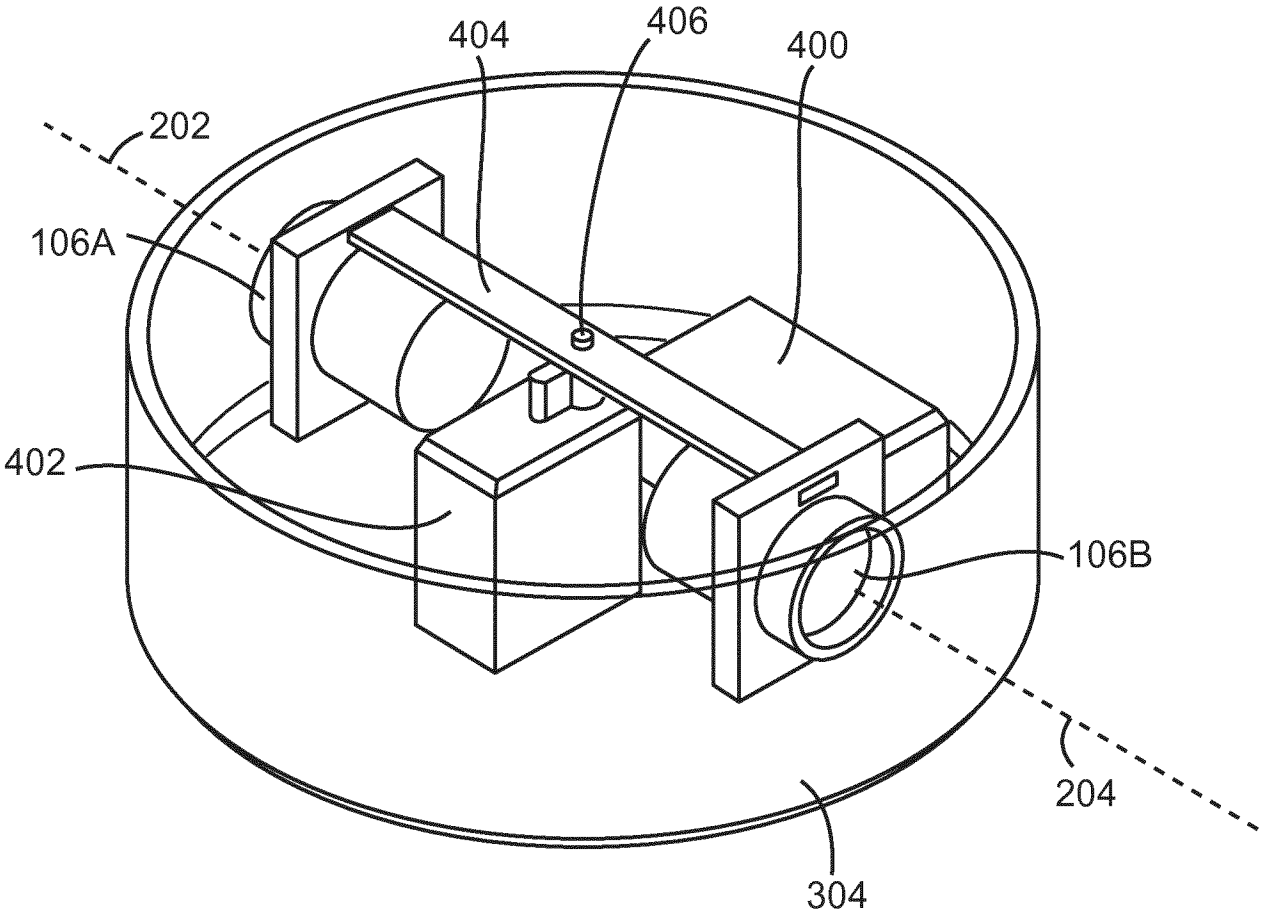
FIG. 4 is a perspective view of a portion of the golf aid of FIG. 3.
Figure 5:
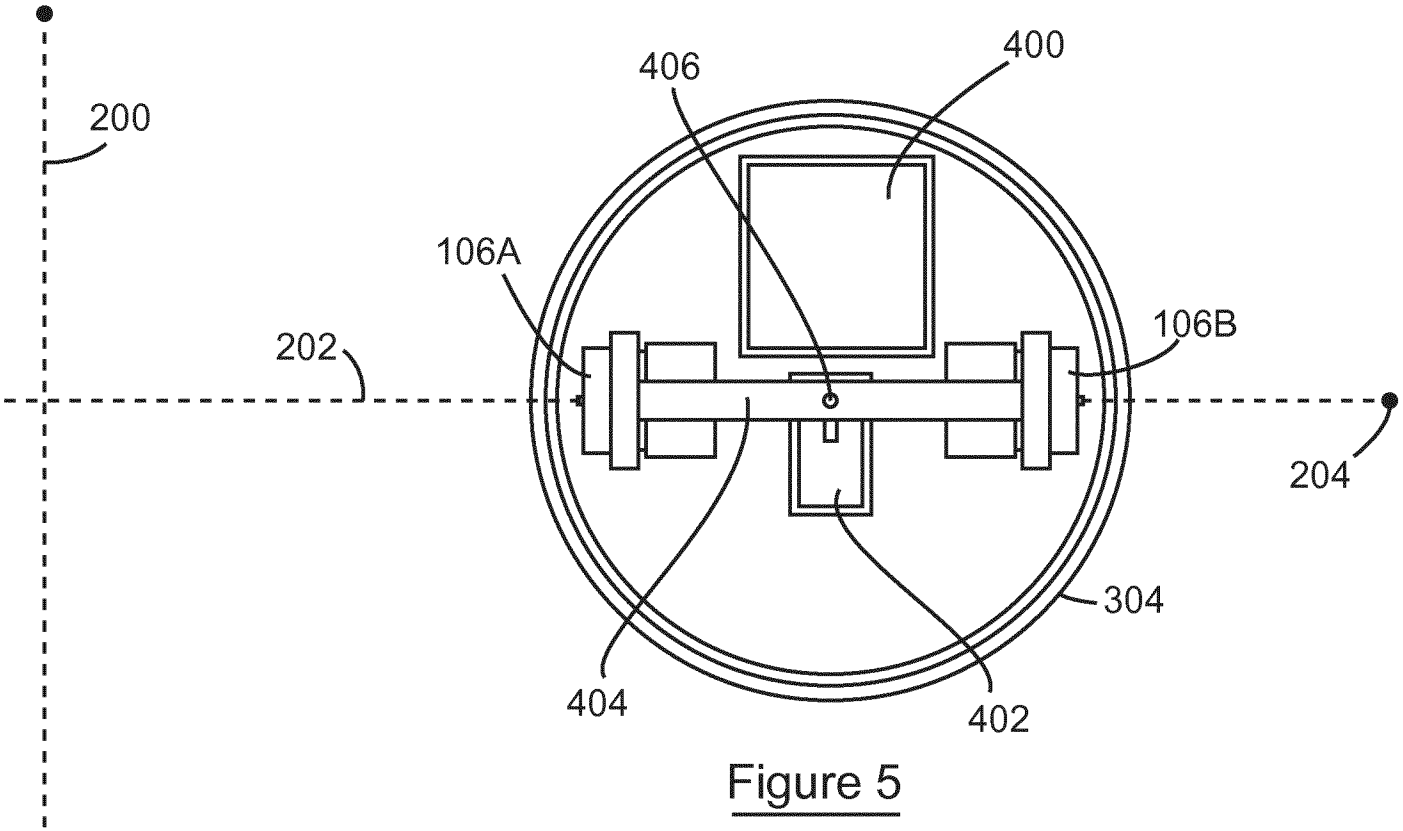
FIG. 5 is a top view of the portion of the golf aid shown in FIG. 4.

Referring to FIGS. 3 to 5 inclusive, there is provided a golf shot set-up and aiming aid in accordance with a further embodiment of the present invention. The golf shot set-up and aiming aid is indicated generally by reference numeral 300, and like parts previously described have been assigned the same reference numerals.

The golf shot set-up and aiming aid 300 comprises an upper casing 302 and a lower casing 304. The upper casing 302 houses a viewfinder 102 and an activation means 306. The lower casing 304 is transparent and comprises a pair of illumination means 106A, 106B. The illumination from the illumination means 106A, 106B will pass through the transparent lower casing 304 to project the proximal centre line 202 and the distal centre line 204. The lower casing 304 further comprises an electronic gyroscope 400, which may preferably be a Micro Electro-Mechanical (MEM) gyroscope, which controls a servo motor 402 to rotate the illumination means 106A, 106B. The illumination means 106A, 106B are mounted at the free ends of a controllable, rotatable cross member 404 in a diametrically opposed arrangement. The servo motor 402 causes the illumination means 106A, 106B to be rotated based on a controlling input from the electronic gyroscope 400.

In use, the user (not shown) will locate an intended target (not shown) through the viewfinder 102 of the golf shot set-up and aiming aid 300. Upon engaging the activation means 306, the orientation of the golf shot set-up and aiming aid 300 is captured by the electronic gyroscope 400 and the illumination means 106A, 106B are illuminated. As the user places the golf shot set-up and aiming aid 300 on the golf playing surface, the orientation towards the intended target is maintained as the illumination means 106A, 106B will be rotated by the servo motor 402 to project the proximal centre line 202 and the distal centre line 204 substantially orthogonally to the imaginary aiming line (not shown) directed at the intended target, and, to project the foot alignment line 200 substantially in parallel with the imaginary aiming line directed at the intended target.

It will be readily understood that the proximal centre line 202 and the distal centre line 204 may be not be projected. Only the foot alignment line 200 would be projected as this would be sufficient to ensure that the correct set-up stance is adopted by the golfer in order to direct their golf shot towards the intended target. The proximal centre line 202 and the distal centre line 204 are used to ensure that the golfer sets up at a correct distance from the golf ball.

Figure 6:
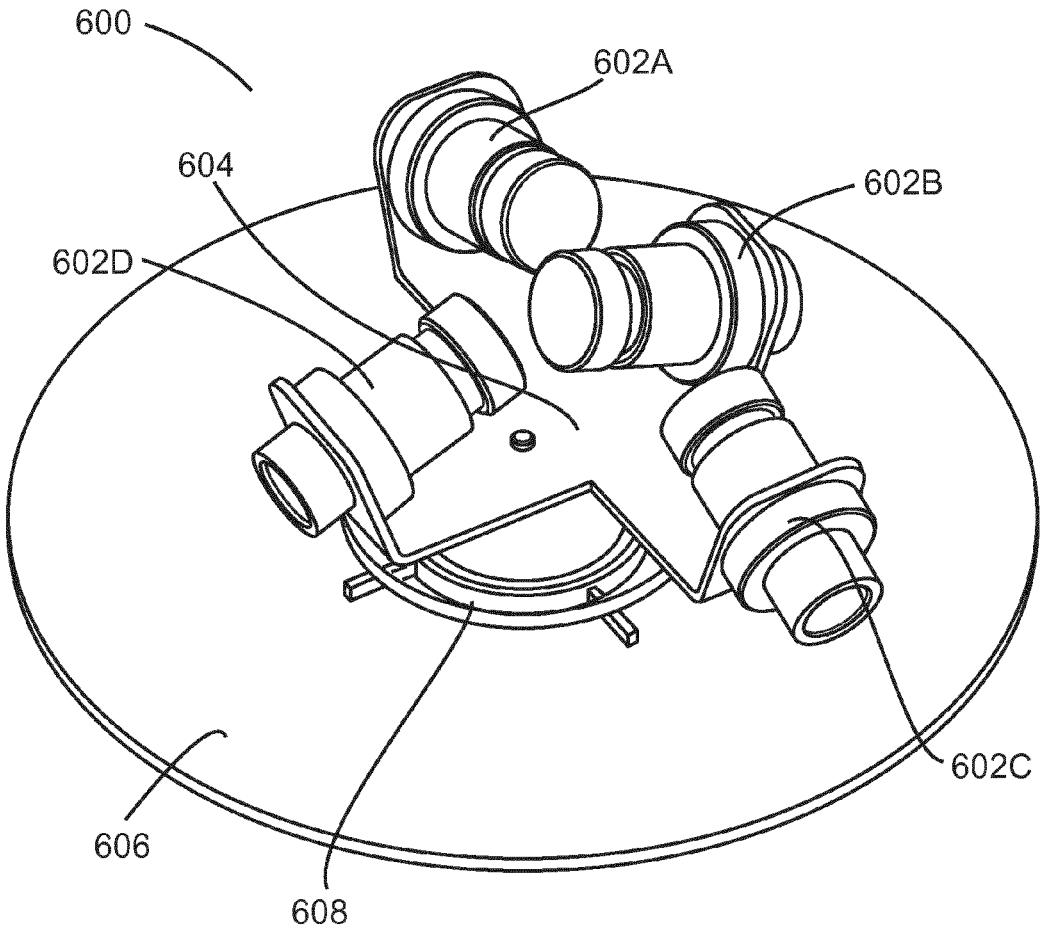
FIG. 6 is a perspective view of a lower portion of a golf aid in accordance with a further embodiment of the present invention.
Figure 7:
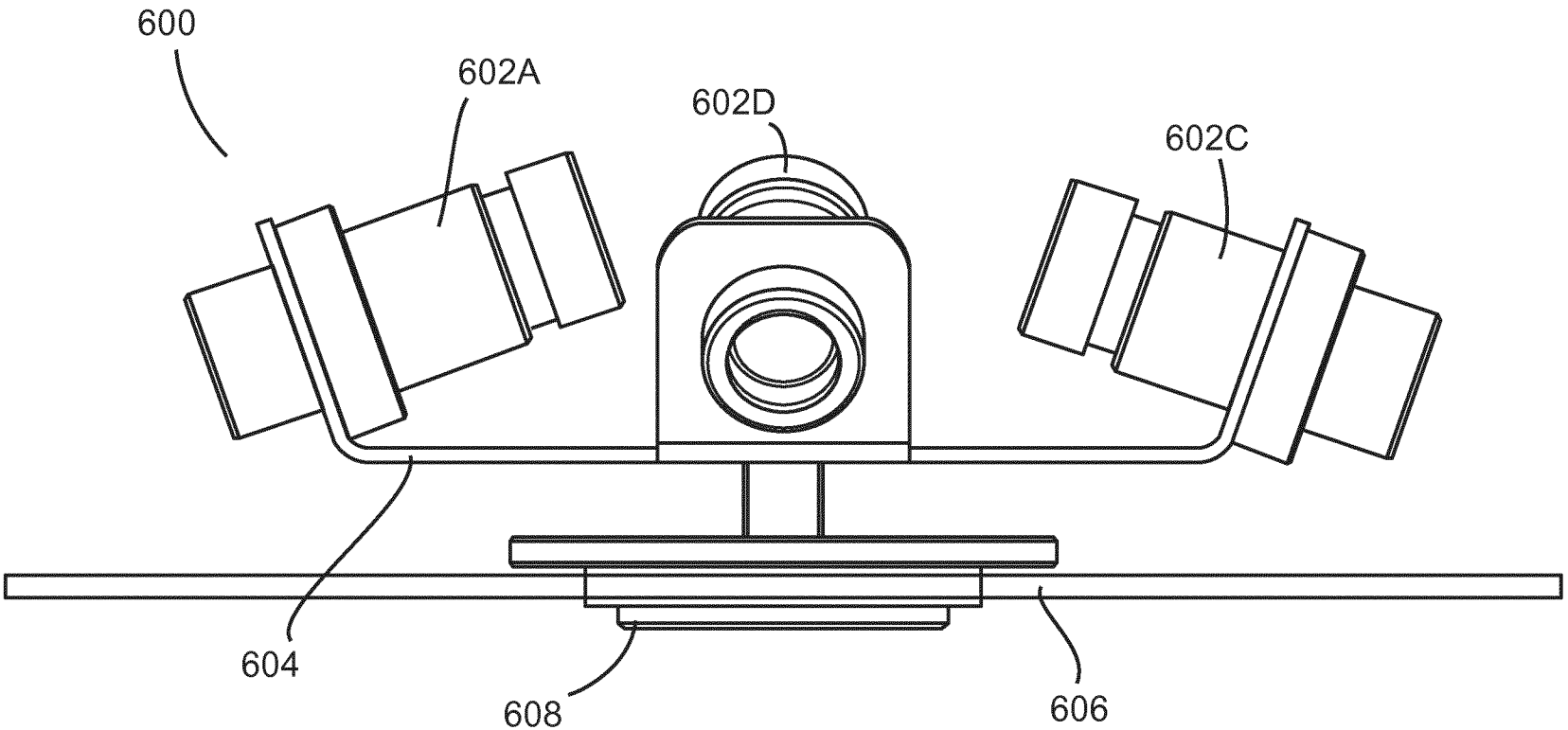
FIG. 7 is a side view of the lower portion of a golf aid of FIG. 6.

Referring to FIGS. 6 and 7, there is shown a lower portion of a golf shot set-up and aiming aid in accordance with a further embodiment of the present invention. The lower portion of the golf shot set-up and aiming aid is indicated generally by reference numeral 600, and like parts previously described have been assigned the same reference numerals. The lower portion of the golf shot set-up and aiming aid 600 comprises four line lasers 602A, 602B, 602C, 602D. The line lasers 602A, 602B, 602C, 602D project the foot alignment line 200, the proximal centre line 202 and the distal centre line 204 as hereinbefore described. The four line lasers 602A, 602B, 602C, 602D are mounted on a rig 604 which is rotatably mounted on a base 606. The rig 604 is rotatable using a small PCB motor 608. The PCB motor 608 may be controlled by an electronic gyroscope (not shown) or a gyroscope (not shown).

Figure 8:
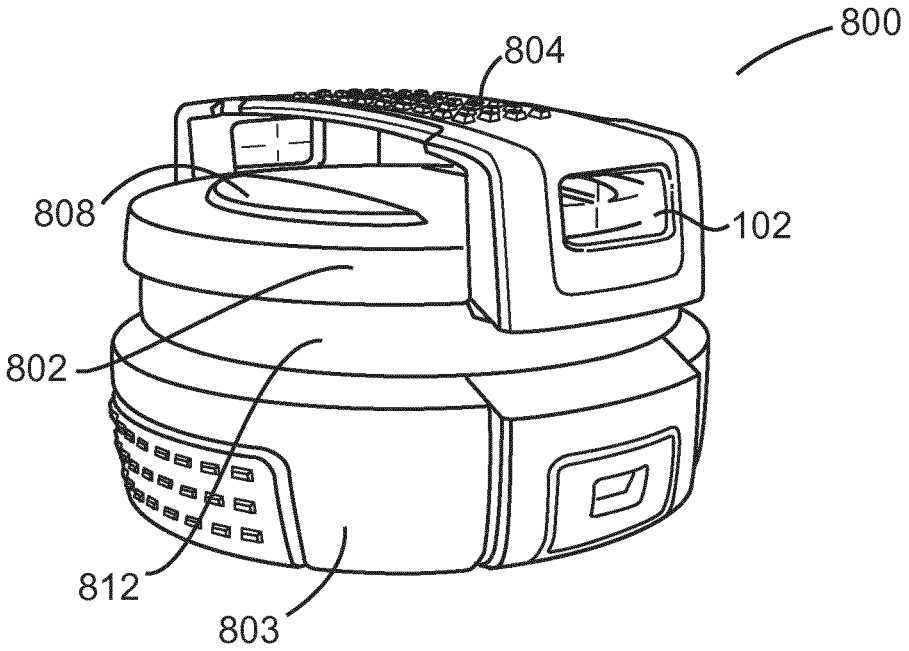
FIG. 8 is a perspective view of a golf aid in accordance with a further embodiment of the present invention.
Figure 9:
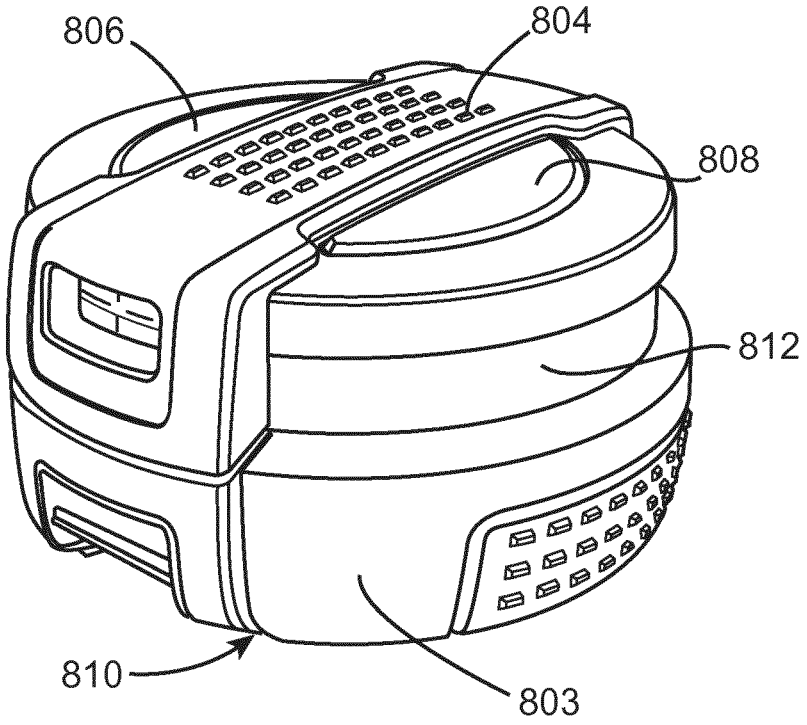
FIG. 9 is a further perspective view of the golf aid of FIG. 8.
Figure 10:
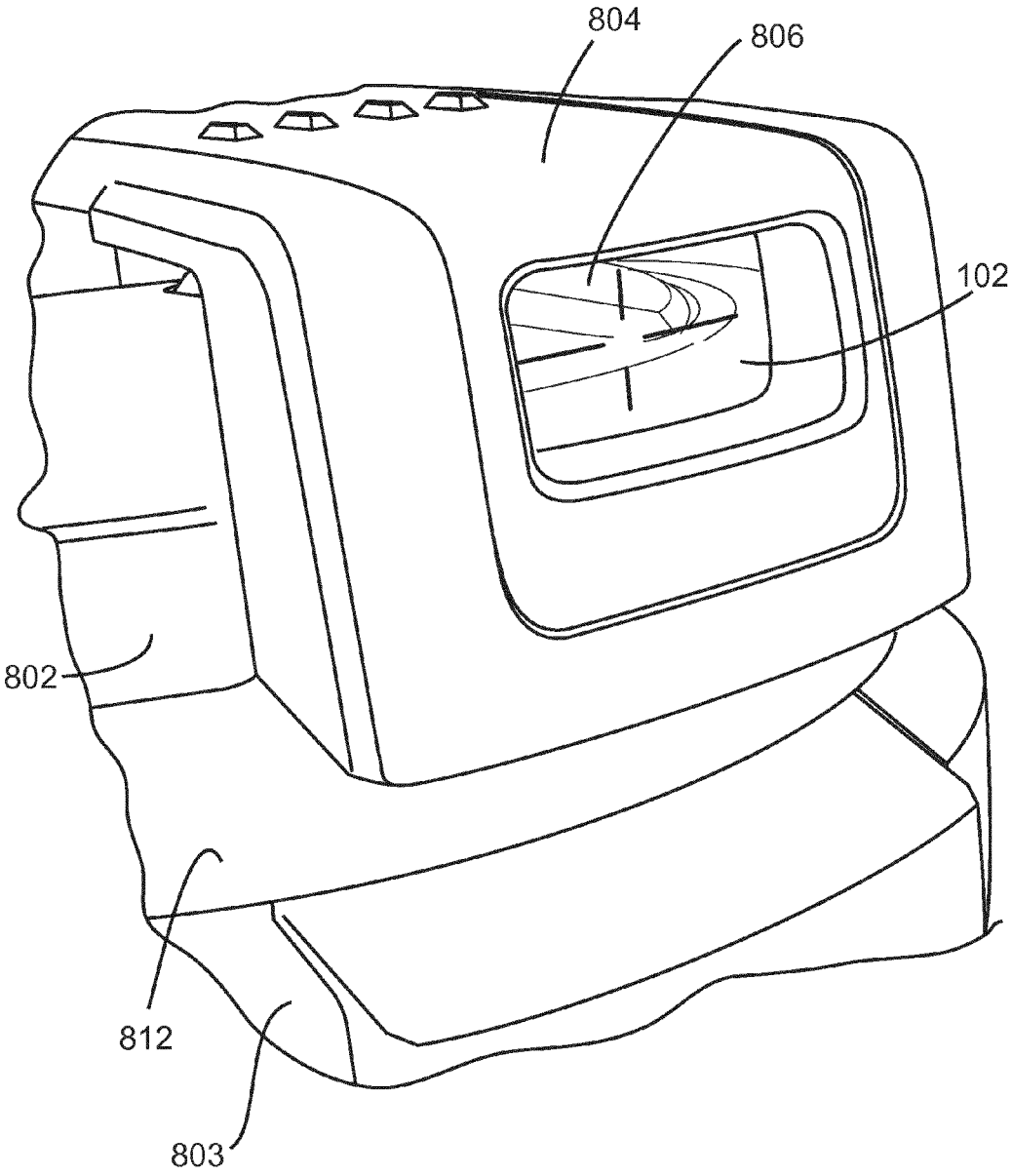
FIG. 10 is a detail view of a viewfinder of the golf aid of FIG. 8.

With reference to FIGS. 8 to 10 inclusive, wherein like parts previously described have been assigned the same reference numerals, there is provided a golf shot set-up and aiming aid indicated generally by reference numeral 800. The golf shot set-up and aiming aid 800 comprises an upper casing 802, an intermediate casing band 812 and a lower casing 803. A deployable viewfinder 102 comprising a pair of cross hair mounted at opposing ends of a moveable bracket 804 form part of an upper face of the golf shot set-up and aiming aid 800. A viewfinder deployment button 806 and an aid activation button 808 are presented on the upper face of the golf shot set-up and aiming aid 800. A substantially planar base face 810 is arranged on an underside of the golf shot set-up and aiming aid 800 to allow the golf shot set-up and aiming aid 800 to be rested on a playing surface (not shown).

Figure 11:
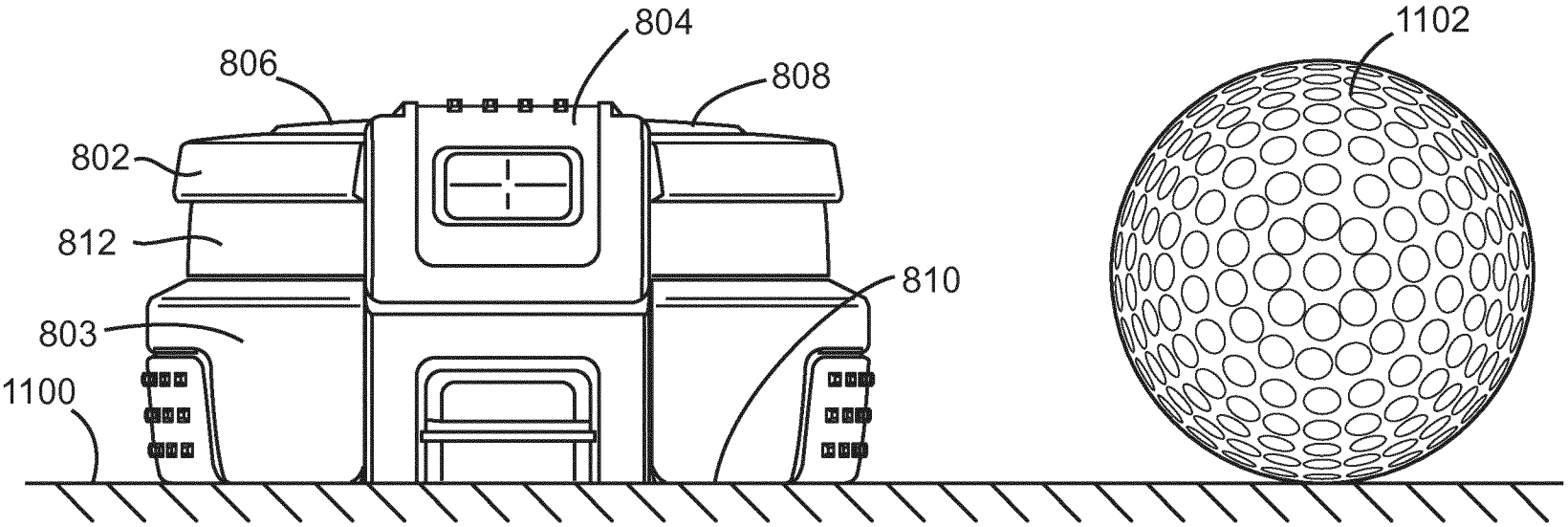
FIG. 11 is a front elevational view of the golf aid of FIG. 8 shown adjacent a golf ball.

Referring to FIG. 11, the golf shot set-up and aiming aid 800 is shown adjacent a golf ball 1102 on a playing surface 1100.

Figure 12:
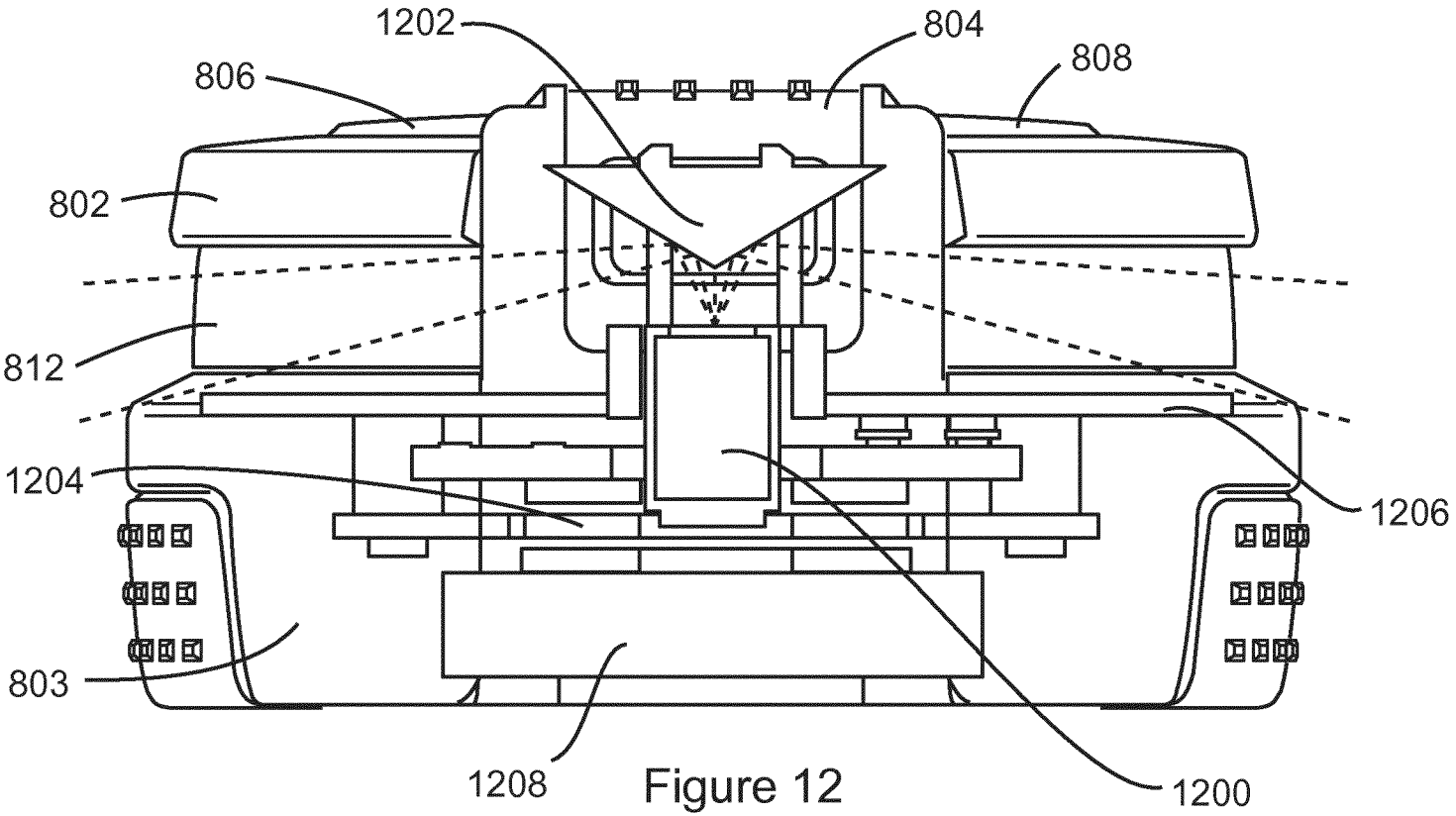
FIG. 12 is a diagrammatic front view of the golf aid of FIG. 8 showing some inner component parts of the golf aid; and, FIG. 13 is a top view of the golf aid of FIG. 8 showing the set-up line and aiming line as would be projected by the golf aid of FIG. 8.

Referring to FIG. 12, the golf shot set-up and aiming aid 800 comprises a illumination device 1200 in the form of a single laser. The illumination device 1200 is mounted to project a plurality of cross-hair patterns upwardly toward a reflector plate 1202. The reflector plate 1202 reflects the laser light out through the intermediate casing band 812 which is preferably transparent so as to allow the laser light to pass through. The illumination means 1200 is rotatable about a substantially vertical axis and may be controllable rotated by a motor 1204. A printed circuit board 1206, comprising inter alia a processor (not shown) is provided within the casing 802, 803, 812 of the golf shot set-up and aiming aid 800. The processor operates the motor 1204 in response to feedback from a direction sensing means (not shown), which may be preferably a Micro Electro-Mechanical (MEM) gyroscope. A battery 1208 is provided to power the golf shot set-up and aiming aid 800.

In use, a user deploys the viewfinder 102 by depressing the viewfinder deployment button 806. In one embodiment, this may wake the processor and other component parts from a power saving mode. The user then uses the viewfinder 102 to direct the golf shot set-up and aiming aid 800 towards an intended target. The user depresses the aid activation button 808 and this causes a voltage from the battery to be established across the Micro Electro-Mechanical gyroscope. This initial position is then established as the user-specified direction. The processor then receives feedback signals from the Micro Electro-Mechanical gyroscope, or other such digital direction sensing means, and the processor correspondingly operates the motor 1204 to rotate the illumination means 1200 and the reflector plate 1202. In this way the illumination means 1200 and the reflector plate 1202 are rotated so as to remain substantially facing in a direction, defined relative to the user-specified direction, through rotation about the substantially vertical axis and in response to feedback from the direction sensing means. The direction in which the illumination means 1200 and the reflector plate 1202 are rotated so as to remain substantially facing in, is a direction, relative to the user-specified direction, in which the set-up line and aiming line which are projected onto a playing surface by the illumination means 1200 and the reflector plate 1202 are directed so that the user will adopt a correct foot alignment stance and aim toward the imaginary target, user-specified direction.

Figure 13:
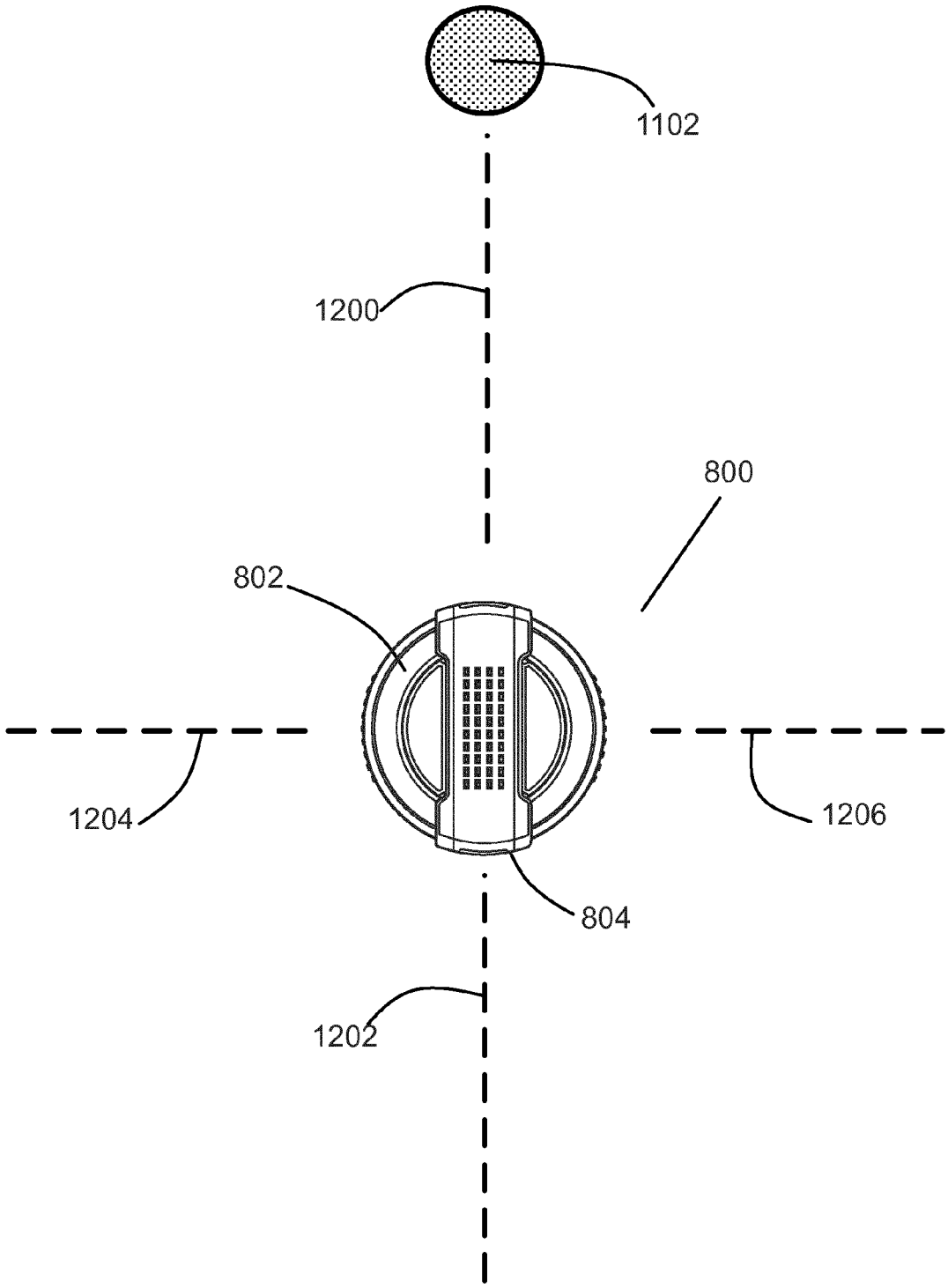

With reference to FIG. 13, the golf shot set-up and aiming aid 800 is shown in an activated state, whereby the set-up line 1204, 1206 and aiming line 1200, 1202 are shown. In this embodiment, the set-up line and the aiming line are configured as a left-side set-up line 1204, a right-side set-up line, an upper aiming line 1200 and a lower aiming line 1202. It will be appreciated that a number of line configurations may be used to project one or more line which are substantially orthogonal to one another so that the user may correctly align their feet and set up their golf stroke and also aim the club head and their golf shot correctly towards their intended target. In the present embodiment, the left-side set-up line 1204 and the right-side set-up line may be used by the golfer to correctly align their feet by placing the foremost point of their feet at each line respectively so that the golf shot set-up and aiming aid 800 is between their feet as they are playing their golf stroke. The upper aiming line 1200 may be used for correctly setting up their club head so that it is substantially orthogonal to the imaginary target direction line. The lower aiming line 1202 can be also used for correctly positioning their feet. For a right-handed golfer, the inside of their left foot should be relatively close to the lower aiming line 1202 when they are using a driver (1W, 3W) and the inside of their right foot should be relatively close to the lower aiming line 1202 when they are using a low iron or wedge (9I, PW, LW). For a mid iron (5I, 6I), the lower aiming line 1202 should be approximately equidistant from the inside of both of their feet.

In a further embodiment, the golf shot set-up and aiming aid 800 may comprise a timer (not shown) so that the direction sensing means and the illumination means 1200 are both activated for a preset period of time. This is advantageous as it allows for a power efficient unit to be devised. The preset period of time, for which the direction sensing means and the illumination means 1200 are both activated, may be varied by the user to accommodate different speeds of play which suit different users. The timer may also be used as an adjustable projection timer which may be adjusted by the user so as to alter the length of time which the illumination means 1200 projects the set-up line and the aiming line on the playing surface for the user. It will be understood that any one or more of the lines projected by the illumination means 1200 may be switched off or dimmed independently of one another so that a user can configure the golf shot set-up and aiming aid 800 to their preference.

The golf shot set-up and aiming aid 800 may also comprise means for altering a distance between the set-up line and the aiming line, when the set-up line and the aiming line are projected onto the playing surface so that golfers of different height, who require different distances between the golf ball and their feet, can refine the golf shot set-up and aiming aid 800 to their individual preference.

In a further embodiment, the illumination means 106A, 106B may also display an aiming line for the golf shot which passes through the ball positioning spot 206.

In another embodiment, it is envisaged that only the aiming line for the golf shot which passes through the ball positioning spot 206 would be projected for putts.

In a further embodiment, the golf shot set-up and aiming aid 100, 300, 800 comprises a motion detection unit (not shown). The motion detection unit allows the golfer to lock onto the intended target in the normal manner and only activate the illumination means 106A, 106B thereafter at their convenience. The golfer will place the golf shot set-up and aiming aid 100, 300, 800 on the golf playing surface and once in place the golfer will then make their stance and then tap the golf shot set-up and aiming aid 100, 300, 800 with their golf club to activate the illumination means 106A, 106B. The golfer can thusly attempt to align themselves to the golf shot correctly and subsequently check to see if they are aligned and positioned correctly. This option may be switched on or switched off using an operation mode switch (not shown) on the golf shot set-up and aiming aid 100, 300, 800.

It will be readily understood that the references herein before to the Micro Electro-Mechanical (MEM) gyroscope will be interpreted as encompassing any type of electronic direction sensing device which is comprised of substantially solid-state materials and is essentially digital in nature.

It will be readily understood that other means of projecting and showing the set-up line and the aiming line for the user may be alternatively used. For example, retractable arms may be deployed to indicate the direction of the set-up line and aiming line. Alternatively direction lines may be shown on the upper casing of the golf shot set-up and aiming aid and a motor may be used to swivel the upper casing so that the direction lines point in the appropriate directions.

In a preferred embodiment, a proximity sensor adjacent a base of the golf shot set-up and aiming aid is used to detect when the golf shot set-up and aiming aid has been placed resting on the playing surface. The illumination means will only project the set-up and aiming lines when the golf shot set-up and aiming aid is resting on the surface. In this manner, laser light will be prohibited from projecting from the golf shot set-up and aiming aid whilst the golf shot set-up and aiming aid is in a user's hand for example.

In a further embodiment, the golf shot set-up and aiming aid may further comprise a range finder to allow a golfer to determine a distance to a pin or their intended target. The range finder may preferably be of a standard laser range finder design; and more preferably the same laser used to project the set-up line and aiming line may be used to determine the distance to a pin or intended target point.

The terms "comprise" and "include", and any variations thereof required for grammatical reasons, are to be considered as interchangeable and accorded the widest possible interpretation.

The invention is not limited to the embodiments hereinbefore described which may be varied in both construction and detail.

The invention claimed is:

1. A golf shot set-up and aiming aid for a user, the aid comprising:

a direction sensing means and at least one illumination means;

the illumination means being capable of projecting a set-up line and an aiming line on a playing surface for the user; and, the illumination means being rotatable about a substantially vertical axis in response to feedback from the direction sensing means.

2. The golf shot set-up and aiming aid as claimed in claim 1, wherein, the aid comprises a motor connected to the illumination means and being capable of rotating the illumination means about the substantially vertical axis.

3. The golf shot set-up and aiming aid as claimed in claim 2, wherein, the aid further comprises a processor and the direction sensing means comprises a Micro Electro-Mechanical gyroscope, wherein the processor receives feedback from the Micro Electro-Mechanical gyroscope regarding any rotation of the aid, and controls the motor to rotate the illumination means so as to account for the rotation of the aid.

4. The golf shot set-up and aiming aid as claimed in claim 3, wherein, the aid further comprises a battery, and, upon the user activating the aid, an electrical voltage is established across the Micro Electro-Mechanical gyroscope using the battery in order to allow the Micro Electro-Mechanical gyroscope to detect any rotation of the aid, and, the battery powers the illumination means to project the set-up line and the aiming line on the playing surface for the user.

5. The golf shot set-up and aiming aid as claimed in claim 4, wherein, the aid further comprises a timer and, upon the user activating the aid, the Micro Electro-Mechanical gyroscope and the illumination means are both activated for a preset period of time.

6. The golf shot set-up and aiming aid as claimed in claim 1, wherein, the direction sensing means comprises a gyroscope.

7. The golf shot set-up and aiming aid as claimed in claim 6, wherein, the illumination means is rotatable about the substantially vertical axis in response to a biasing force provided by the gyroscope.

8. The golf shot set-up and aiming aid as claimed in claim 6, wherein, the gyroscope comprises spinning a gyroscopic wheel rotatable about a gyroscopic axis.

9. The golf shot set-up and aiming aid as claimed in claim 8, wherein, the aid further comprises an activation means which causes the gyroscope to be initially reset to a default position and thereafter activate, and, subsequently causes a user-specified direction to be acquired after activation of the gyroscope.

10. The golf shot set-up and aiming aid as claimed in claim 1, wherein, the direction sensing means is a compass.

11. The golf shot set-up and aiming aid as claimed in claim 1, wherein, upon a user-specified direction being chosen, the illumination means may be rotated so as to remain substantially facing in a direction, defined relative to the user-specified direction, through rotation about the substantially vertical axis and in response to feedback from the direction sensing means.

12. The golf shot set-up and aiming aid as claimed in claim 1, wherein, the illumination means projects the set-up line for a user to correctly align their feet, and, the aiming line for the user to correct align a golf club.

13. The golf shot set-up and aiming aid as claimed in claim 1, wherein, the aiming line comprises a pair of substantially orthogonally arranged lines which project a cross on the playing surface where a golf ball to be played should be located.

14. The golf shot set-up and aiming aid as claimed in claim 1, wherein, the aid further comprises means for altering a distance between the set-up line and the aiming line, when the set-up line and the aiming line are projected onto the playing surface.

15. The golf shot set-up and aiming aid as claimed in claim 1, wherein, the illumination means comprises a plurality of light emitting diodes arranged to display the set-up line for the user's stance and the aiming line.

16. The golf shot set-up and aiming aid as claimed in claim 1, wherein, the aid further comprises an adjustable projection timer which may be adjusted to alter the length of time which the illumination means projects the set-up line and the aiming line on the playing surface for the user.

17. The golf shot set-up and aiming aid as claimed in claim 1, wherein, the illumination means comprises a plurality of lasers to project the set-up line and the aiming line on the playing surface for the user.

18. The golf shot set-up and aiming aid as claimed in claim 1, wherein, the illumination means comprises a single laser and the aid further comprises a reflector, whereby the reflector reflects light from the single laser to project the set-up line and the aiming line on the playing surface for the user.

19. The golf shot set-up and aiming aid as claimed in claim 1, wherein, the illumination means is configured to project the set-up line and the aiming line on the playing surface when the aid is resting on the playing surface.

20. The golf shot set-up and aiming aid as claimed in claim 1, wherein, the aid further comprises a casing having a substantially planar base face, and the illumination means is configured to project the set-up line and the aiming line on the playing surface when the substantially planar base face of the aid is in abutment with the playing surface.

* * * * *